US005626388A

United States Patent [19]

Haltner

[11] Patent Number: 5,626,388

[45] Date of Patent: May 6, 1997

[54] FURNITURE COVER

[76] Inventor: Holly N. Haltner, 1200 Post Oak Blvd. Suite 346, Houston, Tex. 77056

[21] Appl. No.: 332,921

[22] Filed: Nov. 1, 1994

[51] Int. Cl.[6] ..... A47C 31/00

[52] U.S. Cl. ..... 297/228.11; 297/224; 297/218.4; 297/228.1; 297/229

[58] Field of Search ..... 297/218.1, 218.4, 297/218.5, 219.1, 224, 228.1, 228.11, 228.13, 229, 225

[56] References Cited

U.S. PATENT DOCUMENTS

| | | | |
|---|---|---|---|
| 1,242,139 | 10/1917 | Callahan . | |
| 1,820,104 | 8/1931 | Whaley . | |
| 1,889,662 | 11/1932 | Hyman . | |
| 2,112,477 | 3/1938 | Brownfield . | |
| 2,191,956 | 2/1940 | Coldren . | |
| 2,787,862 | 4/1957 | Hoeflich . | |
| 3,348,595 | 10/1967 | Stevens, Jr. . | |
| 3,357,070 | 12/1967 | Sloan . | |
| 3,371,957 | 3/1968 | Cook . | |
| 4,189,808 | 2/1980 | Brown . | |
| 4,357,740 | 11/1982 | Brown . | |
| 4,838,610 | 6/1989 | Perrin . | |
| 4,946,221 | 8/1990 | Livingston | 297/224 X |
| 4,958,886 | 9/1990 | Baratlini . | |
| 5,320,407 | 6/1994 | Tell | 297/228.11 |
| 5,333,921 | 8/1994 | Dinsmoor, III | 297/228.11 X |
| 5,354,119 | 10/1994 | Nicholas | 297/224 X |

FOREIGN PATENT DOCUMENTS

| | | | |
|---|---|---|---|
| 2491315 | 4/1982 | France | 297/228.1 |
| 1813544 | 9/1970 | Germany | 297/218.4 |
| 3510864 | 10/1986 | Germany | 297/218.1 |
| 2109510 | 5/1987 | Japan | 297/228.1 |

OTHER PUBLICATIONS

Textile Fibers, pp. 142–145 Spandex, pp. 45–46.
The Tuxedo Collection, p. 7.

*Primary Examiner*—Laurie K. Cranmer
*Attorney, Agent, or Firm*—Buskop Law Group

[57] ABSTRACT

An article of furniture is inserted into the stretchable tubular fabric sidewall. The tubular fabric sidewall is then conformed to the shape of the article of furniture. The tubular fabric sidewall is open at both ends.

10 Claims, 2 Drawing Sheets

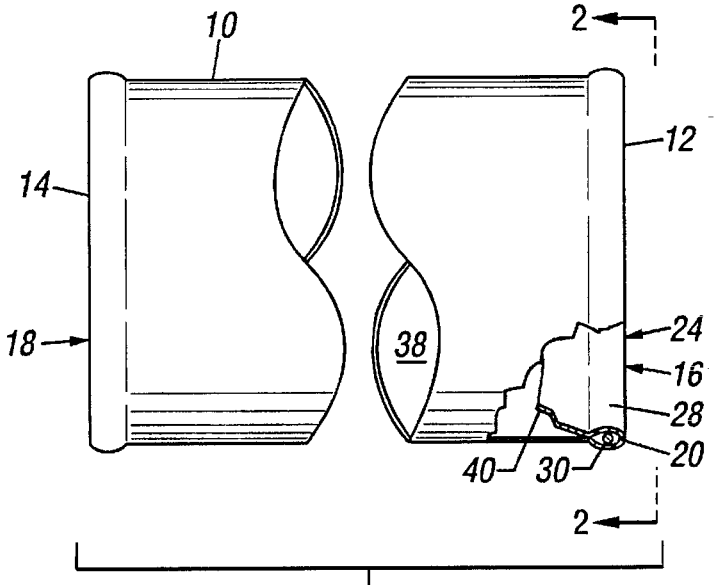
FIG. 1
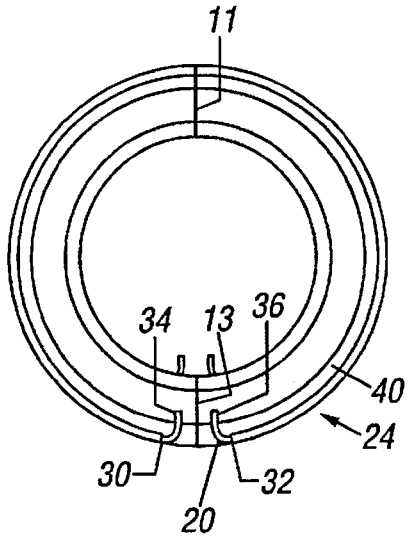
FIG. 2
FIG. 3
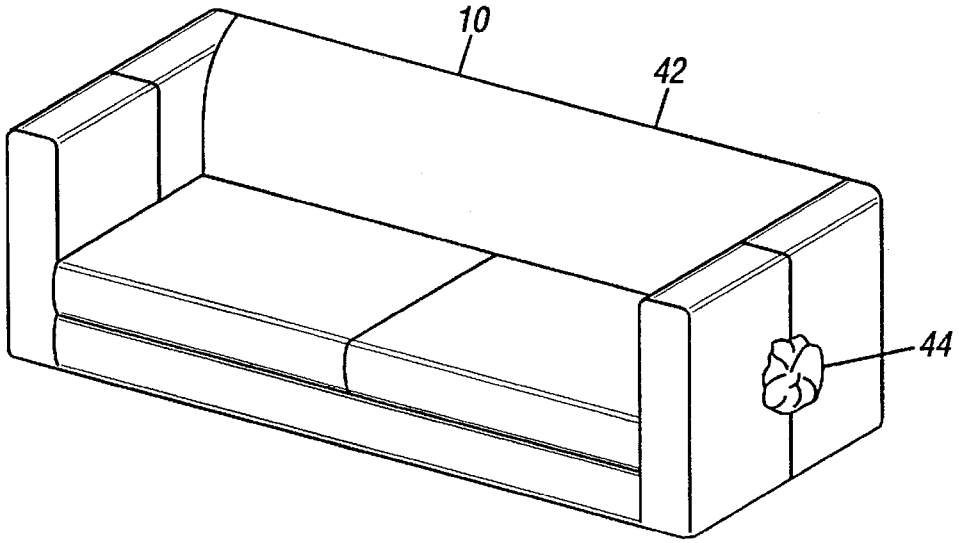

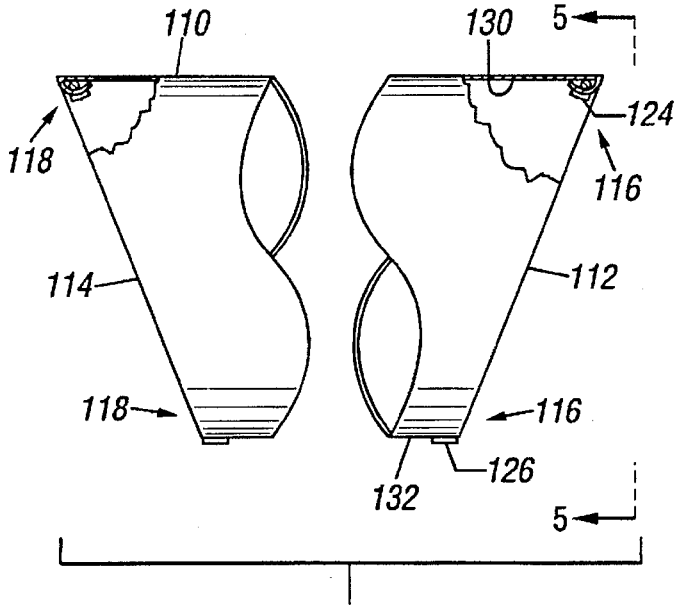
FIG. 4
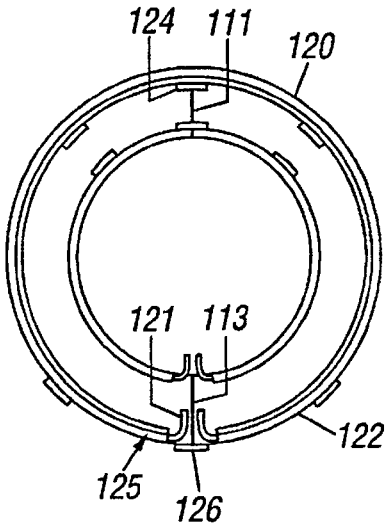
FIG. 5
FIG. 6
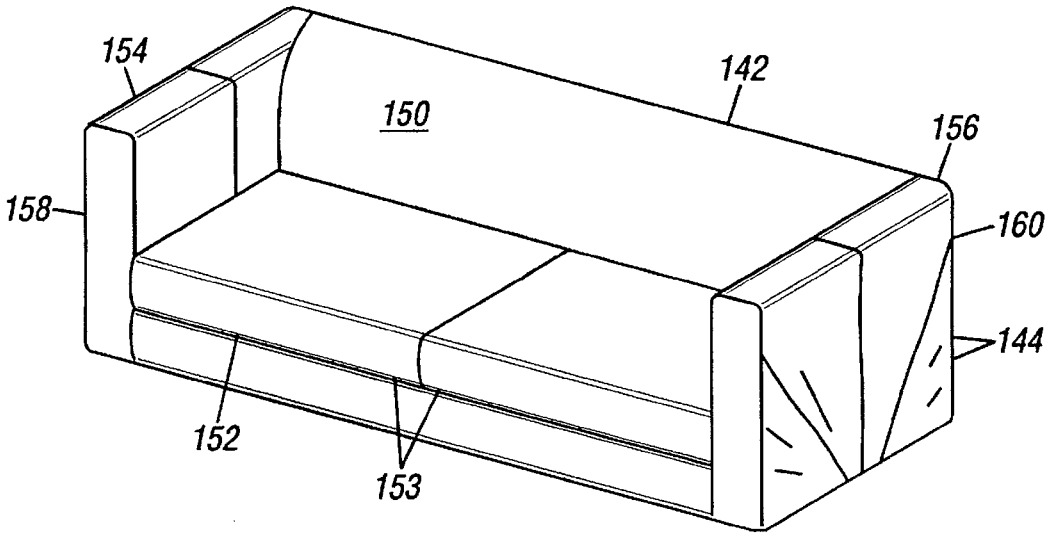

FURNITURE COVER

BACKGROUND OF THE INVENTION

This invention relates to removable slip cover for furniture.

Owners of upholstered furniture occasionally desire to re-cover the furniture with new fabric. The need can arise because of damage or soiling, ordinary wear and tear, or a desire to give the furniture a new look. Sometimes, the owners wish to cover the furniture to give it some protection against soiling hazards such as children or pets.

In the past, the owner's options were to place a slip cover on the furniture or to have it reupholstered. It is difficult to obtain a close fit using commercially available slip covers because furniture comes in such a wide variety of styles and shapes. Custom slip covers are expensive, as is the reupholstering option. There is also the difficulty of locating a suitable professional to do the work and to transport the furniture to and frown the work location. A further problems is that many types of slip covers are not machine washable. A slip cover which could be installed by the consumer and which would provide a close fit for a wide variety of furniture styles and shapes and be machine washable would be very desirable.

OBJECTS OF THE INVENTION

It is an object of this invention to provide a slip cover for furniture which will accommodate a wide variety of furniture sizes.

It is a further object of this invention to provide a slip cover for furniture which will conform well to a wide variety of furniture shapes.

It is another object of this invention to provide a slip cover for furniture which consumers can easily install on a variety of furniture and obtain good results.

SUMMARY OF THE INVENTION

In one embodiment of the invention, there is provided a furniture cover. The furniture cover is formed from a fabric sidewall in the shape of a tube. The tubular fabric sidewall has an open first end and an open second end. At least a longitudinally extending portion of the tubular fabric sidewall is formed from a stretchable material. The tubular fabric sidewall has a length measured between the first end and the second end and a circumference which is adequate to accommodate a range of furniture sizes. A first tubular fabric sidewall closure means is positioned to close the first end of the tubular fabric sidewall. A second tubular fabric sidewall closure means is positioned to close the second end of the tubular fabric sidewall.

In use, an article of furniture is inserted into the stretchable tubular fabric sidewall. The tubular fabric sidewall is then conformed to the shape of the article of furniture. The first end of the tubular fabric sidewall is closed. Then the second end of the tubular fabric sidewall is closed.

Generally speaking the article of furniture will have a back rest structure and a longitudinally elongated seat frame having a first end and a second end and having a longitudinal axis. The article of furniture is positioned inside of the tubular fabric sidewall with the longitudinal axis of the tubular fabric sidewall positioned generally parallel to the longitudinal axis of the seat frame.

When the tubular fabric sidewall is formed from a highly stretchable material, such as "Spandex" and the furniture cushions are covered in the same material and positioned to help conform the covering to the shape of the furniture, the resulting product has a professionally done appearance. Also, because spandex is highly stretchable, a few standardized tube sizes will accommodate a wide range of furniture sizes and shapes.

BRIEF DESCRIPTION OF THE DRAWINGS

FIG. 1 is a side view of a furniture cover illustrating certain features of one embodiment of the invention. A portion of the fabric sidewall has been removed to better show internal details.

FIG. 2 is an end view of the cover shown in FIG. 1 as would be seen along lines 2—2.

FIG. 3 is a pictorial representation of an article of furniture covered by the cover shown in FIG. 1 and 2.

FIG. 4 is a side view of a furniture cover illustrating certain features of another embodiment of the invention. A portion of the fabric sidewall has been removed to better show internal details.

FIG. 5 is an end view of the cover shown in FIG. 4 as would be seen along lines 5—5.

FIG. 6 is a pictorial representation of an article of furniture covered by the cover shown in FIGS. 4 and 5.

DETAILED DESCRIPTION OF THE PREFERRED EMBODIMENTS

In the embodiment of the invention shown by FIGS. 1–3, there is provided a furniture cover 10. The furniture cover 10 is formed from a fabric sidewall in the shape of a tube. The tubular fabric sidewall has an open first end 12 and an open second end 14. A first tubular fabric sidewall closure means 16 is positioned to close the first end 12 of the tubular fabric sidewall. A second tubular fabric sidewall closure means 18 is positioned to close the second end 14 of the tubular fabric sidewall.

The tubular fabric sidewall is preferably formed almost entirely from a stretchable material and has a length measured between the first end and the second end and a circumference as measured around the sidewall which is adequate to accommodate a range of furniture sizes. By stretchable, it is meant that the tubular fabric sidewall is stretchable at least circumferentially. Usually, the tubular sidewall will be stretchable circumferentially in the range of from about 100% to about 500% elongation. Preferably, the tubular fabric sidewall is stretchable both circumferentially and longitudinal. The longitudinal stretchability preferably ranges from about 100% to about 500% elongation. Preferred materials are conventionally spun in the form of tubes and exhibit circumcumferential stretchability along the weft and longitudinal stretchability along the warp. Although polyester/cotton is believed suitable for some applications, spandex is the preferred material for forming the tubular sidewall. Spandex is made under the trademark "Lycra" by Du Pont and "Glospan" by Globe Manufacturing Company. Spandex is a generic term used to describe a family of elastomeric manmade fibers. Spandex has elastic properties which allow the fiber to stretch and snap back into shape like natural rubber. The term "spandex" was adopted by the Federal Trade Commission to identify synthetic elastomers which are chemically different from natural or synthetic rubbers. Technically, spandex describes a manmade fiber in which the fiber-forming substance is a long chain synthetic polymer comprised of at least 85% of a segmented urethane. The structure is achieved by a chemical reaction between a diisocyanate and a second monomer with the formation of a block polymer, in which long chains of a flexible structure are joined to short chains of a stiff structure through urethane linkages. One process for making spandex includes three steps. First, ethylene glycol, propylene glycol, and adipic acid are combined to form a macropolyester with a molecular weight of about 2000. The second step combines the macropolyester with diphenyl methane diisocyanate to form an intermediate polymer. The intermediate is next extended to a high polymer by condensation with an aliphatic diamine such as ethylene diamine. Spandex is characterized by the following properties: High stretch: over 500% without breaking; Low Set: a remarkable ability to spring back to its original shape or set after stretching: High Durability: high tensile and resistance to chafing under stress, resists deterioration due to oxidation: Easy to Clean: may be dry cleaned or laundered; and Dyeability: readily accepts several classes of textile dyes.

Generally speaking, the tubular fabric sidewall will have a circumference in the range of from about 60 inches (203 cm) to about 144 inches (406 cm). In a preferred embodiment of the invention, the tubular fabric sidewall has a circumference of about 115 inches (292 cm). Preferably, the sidewall is produced in such circumference by the weaving process, if flat material is used, a seam will be required to provide the tube of the required circumference. Acceptable results can be providing by splitting and joining a pair of tubes having a 60 inch (152 cm) circumference. This procedure results in a pair of seams 11 and 13 in FIG. 2, and seams 111 and 113 in FIG. 5. The seams are useful as alignment guides. The upper seam of the pair is especially useful as an alignment guide when the tubular fabric sidewall is being positioned an item of furniture.

The length of the tube depends on the length of the article of furniture to be covered. Generally speaking, the tubular fabric sidewall will have a length in the range of from about 50 inches (127 cm) to about 150 inches (381 cm). For couches, a length of about 125 inches (318 cm) is expected to provide good results. For love seats, a length of about 100 inches (254 cm) is expected to provide good results. For chairs, a length of about 75 inches (190 cm) is expected to provide good results.

Seat and back cushions for the article of furniture can be covered with a matching material. Material having a 48 inch (122 cm) circumference taken from a circular knit machine works well for most back cushions. Material having a 60 inch (152 cm) circumference taken from a circular knit machine works well for back cushions. For both types of cushions, releasable closures provided at both ends will provide good results. Draw string closures are preferred. For odd shaped cushions, it is believed desirable to use velcro fasteners in addition to the draw string closures.

The ends 12 and 14 of the tubular fabric sidewall are preferably identical, and this embodiment of the invention will only be described hereinafter as it relates to the end 12. The first tubular fabric sidewall closure means 16 preferably releasably closes the first end of the tubular fabric sidewall. In the illustrated embodiment, the closure means comprises a draw string 20. A means 24 is provided for slidably circumferentially mounting the drawstring 20 adjacent to the first end 12 of the tubular fabric sidewall.

The means 24 for slidably circumferentially mounting the drawstring 20 preferably comprises a tubular fabric strip 28. The strip 28 is circumferentially mounted to the sidewall to define a circumferentially extending tunnel. The tunnel 28 has a first end 30 and a second end 32 positioned closely together and the drawstring 20 is positioned in the tunnel 30. A first end 34 of the drawstring protrudes from the first end 30 of the tunnel and a second end 36 of the drawstring protrudes from a second end 36 of the tunnel.

Preferably, the tunnel 30 is defined adjacent to an inside surface 38 of the tubular sidewall at a position closely adjacent to the first end 12 of the tubular fabric sidewall. This can be accomplished by folding back an end portion of the tube and seaming the fold together. In one embodiment of the invention, the cover further comprises a tubular fabric flap 40 which extends alongside the circumferentially extending tunnel 30. The tubular fabric flap 40 has a first edge attached to the tubular fabric sidewall adjacent to the tunnel 30. The flap 40 extends from the first edge toward the second end 14 of the tubular fabric sidewall. The flap preferably has a finished side facing generally radially inwardly. It can be formed by folding back a greater part of the tube than is necessary to form the tunnel. When the cover is positioned on an article of furniture 42 and the drawstring 20 is tightened to close the end of the tube, the flap 40 can be pulled out through the resulting aperture and arranged by folding to form a rosette 44 on the end of the article of furniture.

In the embodiment of the invention shown by FIGS. 4–6, there is provided a furniture cover 110. The furniture cover 110 is formed from a fabric sidewall in the shape of a tube. The tubular fabric sidewall has an open first end 112 and an open second end 114. A first tubular fabric sidewall closure means 116 is positioned to close the first end 112 of the tubular fabric sidewall. A second tubular fabric sidewall closure means 118 is positioned to close the second end 114 of the tubular fabric sidewall.

The tubular fabric sidewall 110 has a first sidewall portion 120 and a second sidewall portion 122 which extend in side by side relationship from the first end 112 to the second end 114. At least the first sidewall portion 120 is at least circumferentially stretchable. Preferably, the first sidewall portion 120 is also longitudinally stretchable. Most preferably, both the first sidewall portion 120 and the second sidewall portion 122 are longitudinally and circumferentially stretchable. Suitable materials have been previously described.

The ends 112 and 114 of the tubular fabric sidewall are preferably identical, and this embodiment of the invention will only be described hereinafter as it relates to the end 112. The first tubular fabric sidewall closure means 116 preferably comprises a first fastener half 124 mounted to the first sidewall portion 120 closely adjacent to the first end 112 of the tubular fabric sidewall. A second fastener half 126 is mounted to the second sidewall portion closely adjacent to the first end of the tubular fabric sidewall at a position circumferentially spaced apart from the first fastener half 124. The fastener halfs are releasably engageable with each other. Preferably, the second fastener half 126 is circumferentially spaced apart from the first fastener half 124 by an angle of about 180 degrees. More preferably, the first fastener half 124 is attached to an inside surface 130 of the first sidewall portion and the second fastener half 126 is attached to an outside surface 132 of the second sidewall portion 122. This relationship permits a closure which has a neat and professional appearance. In a particularly preferred embodiment of the invention, the first fastener half 124 comprises a first strip of "Velcro" and the second fastener half 126 comprises a second matching strip of "Velcro". The first tubular fabric sidewall closure means 116 preferably further comprises a draw string 121 and a means 125 for slidably circumferentially mounting the drawstring 121 adjacent to the first end 112 of the tubular fabric sidewall. Structure as previously described with reference to FIGS. 1–3 is highly suitable.

In the embodiment of the invention shown in FIGS. 4–6, the end of the tubular fabric sidewall has an organ-pipe cut. The first end 112 of the tubular fabric sidewall 110 lies in a plane which is oblique to the longitudinal axis of the tubular fabric sidewall. The first sidewall portion 120 is longer than the second sidewall portion 122 as measured parallel to the longitudinal axis of the tubular fabric sidewall. The longer side of the tube is preferably positioned on an upper side of the furniture and the shorter side of the tube is preferably positioned on the bottom side of the furniture. This configuration permits the cover to be positioned on an article of furniture 142 and the closure to form a neat series of folds 144 on the end of the article of furniture. During the installation process the seams assist in aligning the tubular fabric side on the item of furniture.

Both embodiments of the invention are used by inserting an article of furniture into the stretchable tubular fabric sidewall. The upper seam may be used as an alignment guide. The tubular fabric sidewall is then conformed to the shape of the article of furniture. The first end of the tubular fabric sidewall is closed. Then the second end of the tubular fabric sidewall is closed.

The resulting product comprises all article of furniture having a stretchable tubular fabric sidewall positioned thereon. Referring generally to FIG. 6, the article of furniture 142 will have a back rest structure 150 and a longitudinally elongated seat frame 152 under cushions 153. The seat frame has a longitudinal axis. The item of furniture usually also has a first arm rest 154, and a second arm rest 156. The article of furniture has a first end 158 adjacent to the first arm rest 154 and a second end 160 adjacent to the second arm rest 156. The article of furniture (preferably sans removable cushions) is positioned inside of the stretchable tubular fabric sidewall with the stretchable fabric conforming to the shape of the furniture. Generally speaking, the tubular fabric sidewall conforms to the back rest structure, the seat frame, and the arm rests when present. The first end of the stretchable tubular fabric sidewall is positioned adjacent to the first end of the article of furniture. The second end of the stretchable tubular fabric sidewall is positioned adjacent to the second end of the article of furniture. The first releasable tubular fabric sidewall closure means is positioned in closing relationship with the first end of the tubular fabric sidewall. The second tubular fabric sidewall closure means is positioned in closing relationship with the second end of the tubular fabric sidewall.

The cushions 153 assist in conforming the tubular fabric sidewall to the article of furniture when they have been removed and are then reinstalled over the tubular fabric sidewall. Each seat cushion 153 is positioned over the tubular fabric sidewall and in engagement with the seat frame 152 through the tubular fabric sidewall. The seat cushions hold the tubular fabric sidewall in conformance with the back rest structure 150, the first arm rest 154, and the second arm rest 156. When the cushions 153 are not removable, or have simply not been removed, the tubular fabric sidewall may be conformed by wedging pieces of foam between the cushions and adjacent structure.

While certain preferred embodiments of the invention have been herein described, the invention is not to be so limited, except to the extent such limitations are found in the claims.

What is claimed is:

1. A furniture cover comprising a fabric sidewall in the shape of a tube and forming a tubular fabric sidewall, said tubular fabric sidewall having a first end, a second end, a length measured between the first end and the second end, and a circumference, at least a longitudinally extending portion of said tubular fabric sidewall being circumferentially stretchable;

a first tubular fabric sidewall closure means positioned to close the first end of the tubular fabric sidewall;

a second tubular fabric sidewall closure means positioned to close the second end of the tubular fabric sidewall;

wherein the first tubular fabric sidewall closure means releasably closes the first end of the tubular fabric sidewall;

wherein the second tubular fabric sidewall closure means releasably closes the second end of the tubular fabric sidewall;

wherein the first tubular fabric sidewall closure means comprises a draw string; and means for slidably circumferentially mounting the drawstring adjacent to the tubular fabric sidewall;

wherein the means for slidably circumferentially mounting the drawstring comprises a tubular fabric strip circumferentially mounted to the sidewall to define a circumferentially extending tunnel, said tunnel having a first end and a second end positioned closely together and the drawstring is positioned in the tunnel with a first end of the drawstring protruding from the first end of the tunnel and a second end of the drawstring protruding from a second end of the tunnel;

wherein the tunnel is positioned on an inside surface of the tubular sidewall at a position closely adjacent to the first end of the tubular fabric sidewall, wherein the furniture cover further comprises a fabric flap extending alongside the circumferentially extending tunnel, said fabric flap having a first edge attached to the tubular sidewall adjacent to the tunnel, said flap extending from the first edge toward the second end of the tubular fabric sidewall.

2. A furniture cover comprising a fabric sidewall in the shape of a tube and forming a tubular fabric sidewall, said tubular fabric sidewall having a first end, a second end, a length measured between the first end and the second end, and a circumference, at least a longitudinally extending portion of said tubular fabric sidewall being circumferentially stretchable;

a first tubular fabric sidewall closure means positioned to close the first end of the tubular fabric sidewall;

a second tubular fabric sidewall closure means positioned to close the second end of the tubular fabric sidewall;

wherein the first tubular fabric sidewall closure means releasably closes the first end of the tubular fabric sidewall;

wherein the tubular fabric sidewall has a first sidewall portion and a second sidewall portion which extend in side by side relationship from the first end to the second end; wherein at least the first sidewall portion is at least circumferentially stretchable;

wherein the first tubular fabric sidewall closure means comprises a first fastener half mounted to the first sidewall portion closely adjacent to the first end of the tubular fabric sidewall and a second fastener half mounted to the second sidewall portion closely adjacent to the first end of the tubular fabric sidewall member at a position circumferentially spaced apart from the first fastener half;

wherein the second fastener half is circumferentially spaced apart from the first fastener half by an angle of about 180 degrees;

wherein the tubular fabric sidewall has a longitudinal axis and the first end of the tubular fabric sidewall lies in a plane which is oblique to the longitudinal axis and the first sidewall portion is longer than the second sidewall portion as measured parallel to the longitudinal axis of the tubular fabric sidewall;

wherein the first fastener half is attached to an inside surface of the first sidewall portion and the second fastener half is attached to an outside surface of the second sidewall portion.

3. A furniture cover as in claim 2 wherein the first tubular fabric sidewall closure means further comprises a draw string; and means for slidably circumferentially mounting the drawstring adjacent to the tubular fabric sidewall.

4. A furniture cover as in claim 2 wherein the first fastener half comprises a first strip of "Velcro" and the second fastener half comprises a second matching strip of "Velcro".

5. A furniture cover comprising a fabric sidewall in the shape of a tube and forming a tubular fabric sidewall, said tubular fabric sidewall having a first end, a second end, a length measured between the first end and the second end, and a circumference, at least a longitudinally extending portion of said tubular fabric sidewall being circumferentially stretchable;

a first tubular fabric sidewall closure means positioned to close the first end of the tubular fabric sidewall;

a second tubular fabric sidewall closure means positioned to close the second end of the tubular fabric sidewall;

wherein the first tubular fabric sidewall closure means releasably closes the first end of the tubular fabric sidewall;

wherein the tubular fabric sidewall has a first sidewall portion and a second sidewall portion which extend in side by side relationship from the first end to the second end;

wherein the first tubular fabric sidewall closure means comprises a first fastener half mounted to the first sidewall portion closely adjacent to the first end of the tubular fabric sidewall and a second fastener half mounted to the second sidewall portion closely adjacent to the first end of the tubular fabric sidewall member at a position circumferentially spaced apart from the first fastener half;

wherein the second fastener half is circumferentially spaced apart from the first fastener half by an angle of about 180 degrees;

wherein the tubular fabric sidewall has a longitudinal axis and the first end of the tubular fabric sidewall lies in a plane which is oblique to the longitudinal axis and the first sidewall portion is longer than the second sidewall portion as measured parallel to the longitudinal axis of the tubular fabric sidewall;

wherein the first fastener half is attached to an inside surface of the first sidewall portion and the second fastener half is attached to an outside surface of the second sidewall portion;

wherein the first tubular fabric sidewall closure means further comprises a draw string;, and means for slidably circumferentially mounting the drawstring adjacent to the tubular fabric sidewall;

wherein both of the first sidewall portion and the second sidewall portion are longitudinally and circumferentially stretchable.

6. A furniture cover as in claim 5 wherein the tubular fabric sidewall is formed from spandex.

7. A article of furniture having a cover formed from a tubular fabric sidewall positioned thereon, said article of furniture having a back rest structure and an elongated seat frame having a first end and a second end and a longitudinal axis connected to the back rest structure, said article of furniture being positioned inside of the tubular fabric sidewall, wherein the tubular fabric sidewall comprises a tubularly shaped sidewall formed from a fabric material having a first end and a second end and a longitudinal axis positioned generally parallel to the longitudinal axis of the seat frame, wherein the first end of the tubularly shaped sidewall of the fabric material is positioned in covering relationship with the first end of the elongated seat frame and the second end of the tubularly shaped sidewall of the fabric material is positioned in covering relationship with the second end of the elongated seat frame so that the entire article of furniture is covered by the tubular fabric sidewall.

8. An article of furniture having a cover formed from a tubular fabric sidewall positioned thereon, said article of furniture having a back rest structure, an elongated seat frame having a first end, a second end, and a longitudinal axis, a first arm rest, a first furniture end adjacent to the first arm rest, a second arm rest, and a second furniture end adjacent to the second arm rest, said article of furniture being positioned inside of the tubular fabric sidewall, wherein the tubular fabric sidewall comprises a tubularly shaped sidewall formed from a fabric material having a first end and a second end and a longitudinally axis positioned generally parallel to the longitudinally axis of the seat frame, wherein the first end of the tubular fabric sidewall is positioned adjacent to the first furniture end and the second end of the tubular fabric sidewall is positioned adjacent to the second furniture end, wherein the tubular fabric sidewall further comprises a first releasable tubular fabric sidewall closure means positioned in closing relationship with the first end of the tubular fabric sidewall; and a second tubular fabric sidewall closure means positioned in closing relationship with the second end of the tubular fabric sidewall.

9. An article of furniture as in claim 8 further comprising at least one seat cushion positioned over the tubular fabric sidewall and in engagement with the seat frame through the tubular fabric sidewall, wherein the at least one seat cushion holds the tubular fabric sidewall in conformance with the back rest structure, the first arm rest, and the second arm rest.

10. A method for covering an article of furniture comprising a back rest structure and an elongated seat frame having a first end and a second end and a longitudinal axis connected to the back rest structure with a cover formed from a tubular fabric sidewall, said method comprising providing a furniture cover formed from tubular fabric sidewall, said tubular fabric sidewall being formed from a stretchable tubular fabric and having an open first end and an open second end;

inserting the entire article of furniture into the tubular fabric sidewall;

conforming the tubular fabric sidewall to the article of furniture;

closing the first end of the tubular fabric sidewall; and closing the second end of the tubular fabric sidewall;

so that the entire article of furniture is covered by the tubular fabric sidewall.

* * * * *